US008575542B1

(12) United States Patent
Park et al.

(10) Patent No.: US 8,575,542 B1
(45) Date of Patent: Nov. 5, 2013

(54) METHOD AND DEVICE FOR GAS-PHASE ION FRAGMENTATION

(75) Inventors: Melvin Andrew Park, Billerica, MA (US); Desmond Allen Kaplan, Billerica, MA (US)

(73) Assignee: Bruker Daltonics, Inc., Billerica, MA (US)

( * ) Notice: Subject to any disclaimer, the term of this patent is extended or adjusted under 35 U.S.C. 154(b) by 15 days.

(21) Appl. No.: 13/449,436

(22) Filed: Apr. 18, 2012

(51) Int. Cl.
*H01J 49/00* (2006.01)

(52) U.S. Cl.
USPC ..... 250/281; 250/282; 250/288

(58) Field of Classification Search
USPC ..... 250/281, 282, 288
See application file for complete search history.

(56) References Cited

U.S. PATENT DOCUMENTS

| | | | | |
|---|---|---|---|---|
| 4,924,089 | A | 5/1990 | Caravatti | |
| 6,919,562 | B1 | 7/2005 | Whitehouse | |
| 7,049,584 | B1 | 5/2006 | Whitehouse | |
| 7,534,622 | B2 | 5/2009 | Hunt | |
| 7,755,034 | B2 | 7/2010 | Ding | |
| 7,838,826 | B1 | 11/2010 | Park | |
| 2004/0245448 | A1 * | 12/2004 | Glish et al. | 250/281 |

OTHER PUBLICATIONS

Zubarev et al.; "Electron Capture Dissociation of Multiply Charged Protein Cations. A Nonergodic Process"; J. Am. Chem. Soc.; 120 (13): 3265-3266 (1998).
Syka et al.; "Peptide and Protein Sequence Analysis by Electron Transfer Dissociation Mass Spectrometry", Proc. Natl. Acad. Sci. U.S.A.; 101 (26): 9528-9533 (2004).
Voinov et al.; "Electron Capture Dissociation in a Linear Radiofrequency-free Magnetic Cell"; Rapid Commun. Mass Spectrom., 22(19), 3087-3088 (2008).

* cited by examiner

*Primary Examiner* — Michael Maskell
(74) *Attorney, Agent, or Firm* — O'Shea Getz P.C.

(57) ABSTRACT

The invention relates to a device for performing electron capture dissociation on multiply charged cations. Provided is an electron emitter which, upon triggering, emits a plurality of low energy electrons suitable for efficient electron capture reactions to occur. Further, the device contains a particle emitter being located proximate to the electron emitter and being capable, upon triggering, to emit a plurality of high energy charged particles substantially in a direction towards the electron emitter in order that the electron emitter receives a portion of the emitted plurality of high energy charged particles and emission of the plurality of low energy electrons is triggered. A volume capable of containing a plurality of multiply charged cations is located in opposing relation to the electron emitter such that the volume receives the plurality of low energy electrons upon emission as to allow electron capture dissociation to occur.

20 Claims, 4 Drawing Sheets

METHOD AND DEVICE FOR GAS-PHASE ION FRAGMENTATION

BACKGROUND

The invention relates generally to the field of gas phase ion fragmentation techniques, and more precisely to electron capture dissociation (ECD) which is used to fragment gas-phase analyte ions such as large biopolymer ions in order to obtain structural information via mass spectrometry.

A gas-phase ion fragmentation technique frequently used in the field of mass spectrometry is the collision-induced dissociation (CID), sometimes also called collisionally activated dissociation (CAD). Molecular ions are usually accelerated by an electrical potential to high kinetic energy and then allowed to collide with quasi-stationary neutral molecules of a background gas, such as helium, nitrogen or argon which are largely chemically inert in order to prevent chemical reactions from occurring. In the collision, some of the kinetic energy is converted into internal energy which results in bond breakage and the fragmentation of the molecular ion into smaller fragments, at least some of which carry unbalanced charges. These charged fragment ions can then be analyzed by a mass spectrometer, such as a linear or three-dimensional quadrupole mass analyzer, linear or orthogonal accelerated time-of-flight analyzer, ion cyclotron resonance analyzer and the like.

Electron-capture dissociation, initially described by Roman Zubarev, Neil Kelleher, and Fred McLafferty (Zubarev et al. (1998); "Electron capture dissociation of multiply charged protein cations. A nonergodic process"; J. Am. Chem. Soc.; 120 (13): 3265-3266), on the other hand, is a gas-phase ion fragmentation method which taps the energy reservoir of a recombination reaction between cations and free electrons. ECD involves the mixing of low energy electrons with gas phase ions which, according to recent developments, can be trapped in a suitable trapping device, such as 3D (Paul type) ion trap, 2D linear ion trap and the like. An example of such a trap arrangement is disclosed, for example, in U.S. Pat. No. 7,755,034 to Ding.

An ECD reaction normally involves a multiply protonated molecule M interacting with a free electron to form an odd-electron ion:

$$[M+nH]^{n+}+e^{-}\rightarrow[[M+nH]^{(n-1)+}]^{*}\rightarrow\text{fragments.}$$

Adding an electron to an incomplete molecular orbital of the reactant cation releases binding energy which, if sufficient to exceed a dissociation threshold, causes the fragmentation of the electron acceptor ion.

ECD produces significantly different types of fragment ions, primarily of the c and z type, than aforementioned CID which primarily yields the b and y type. CID introduces internal vibrational energy in the cation in an ergodic process generally affecting the weakest bonds and thus causing loss of post-translational modifications (PTM) such as phosphorylation and O-glycosylation during fragmentation. In ECD, on the other hand, these PTMs are largely retained in the fragments. Consequently, in ECD unique fragments can be observed which are largely complementary to CID fragments thereby allowing a more detailed structural elucidation of the reactant cation. However, low fragmentation efficiencies and other experimental difficulties, in particular the problem of simultaneously confining ions with high masses and light electrons (the mass of an electron is about 1,836 times smaller than that of a proton), posed a hindrance hitherto for the utility of ECD. A further challenge is to provide electrons with sufficiently low kinetic energy as to allow electron capture reactions to occur.

Another gas-phase ion fragmentation technique tapping the energy reservoir of a recombination reaction is called electron-transfer dissociation (ETD). Similar to electron-capture dissociation, ETD induces fragmentation of cations of interest, such as peptides or proteins, by an electron transfer from a suitable reagent anion, both reactants normally being confined in an ion trap. The scientific potential of this process using polyaromatic reagent anions was first realized by Donald Hunt, Joshua Coon, John Syka and Jarrod Marto (Syka et al. (2004); "Peptide and protein sequence analysis by electron transfer dissociation mass spectrometry"; Proc. Natl. Acad. Sci. U.S.A.; 101 (26): 9528-9533; see also U.S. Pat. No. 7,534,622 to Hunt et al.).

In contrast to ECD, ETD does not use free electrons but employs anions, preferably radical polyaromatic anions of anthracene or fluoranthene, as electron donors in a charge transfer reaction:

$$[M+nH]^{n+}+A^{-}\rightarrow[[M+nH]^{(n-1)+}]^{*}\rightarrow\text{fragments}$$

where $A^{-}$ is the anion. Just like ECD, the ETD fragmentation technique is considered beneficial as it cleaves randomly along the peptide backbone of the electron acceptor cation in a non-ergodic process, yielding fragments of the c and z type, while side chains and modifications such as phosphorylations are left intact. Therefore, ETD, as much as ECD, is complementary to CID and is thought to be advantageous for the fragmentation of longer peptides or even entire proteins raising its value for top-down proteomics. One reason why ETD is nowadays in more widespread use than ECD is that the masses of the reactant cations and anions do not diverge as much as the masses of reactant cations and electrons making it easier to simultaneously confine them in an ion trap, for instance. On the other hand, one difficulty with ETD is that the electron transfer reactions compete with other reaction types such as proton transfer, ion attachment and the like, resulting in different individual branching ratios and ETD yields that depend on the pair of reagents used. Such competition of reaction pathways does not exist with ECD.

Since the first application of ECD in an ion cyclotron resonance cell the technique associated therewith was further advanced. Glish et al. (US 2004/0245448 A1), for example, describe a mass spectrometer capable of performing ECD that comprises a first mass analyzer, a magnetic trap downstream of the first mass analyzer, a second mass analyzer downstream of the magnetic trap, and an electron source positioned such that electrons are supplied to the magnetic trap. Whitehouse et al. (U.S. Pat. No. 6,919,562 B1 and U.S. Pat. No. 7,049,584 B1) disclose an apparatus that enables the interaction of low energy electrons with sample ions to facilitate ECD within multipole ion guide structures. Voinov et al. (Rapid Commun. Mass Spectrom., 2008, 22(19), 3087-3088) report on ECD performed in a linear, radio frequency free, hybrid electrostatic/magnetostatic cell without the aid of a cooling gas.

SUMMARY

In a first aspect, the invention relates to a device for performing electron capture dissociation on multiply charged cations, comprising an electron emitter which, upon triggering, emits a plurality of low energy electrons suitable for efficient electron capture reactions to occur, a particle emitter being located proximate to the electron emitter and being capable, upon triggering, to emit a plurality of high energy charged particles substantially in a direction towards the electron emitter in order that the electron emitter receives a portion of the emitted plurality of high energy charged particles and emission of the plurality of low energy electrons is triggered, and a volume capable of containing a plurality of multiply charged cations and located in opposing relation to the electron emitter such that the volume receives the plurality of low energy electrons upon emission as to allow electron capture dissociation to occur.

In various embodiments, the electron emitter is a conversion dynode. The conversion dynode may be supplied with a low negative polarity operation voltage of between 0.1 and 10 volts, preferably about one volt. With such operational settings, it can be reliably ensured that the emitted electrons have kinetic energies sufficiently low for electron capture dissociation to occur. In other embodiments, the electron emitter may be a simple plate made of a material capable of providing a large number of electrons upon impingement of high energy charged particles, such as a metal plate made of copper, for example.

In various embodiments, the particle emitter is a microchannel plate, and the plurality of high energy charged particles is a plurality of high energy electrons. High energy charged particles are supposed to have a kinetic energy generally equal to or higher than fifty electron volts. High energy charged particles, in case of electrons themselves not suitable for effective ECD, can be advantageously employed to generate a large number of low energy electrons so that a sufficient probability for an ECD reaction results when multiply charged cations are intermingled with the large number of low energy electrons. Under certain circumstances, the high energy electrons emitted from a microchannel plate have a broad energy distribution which has a full width of around sixty electron volts at half maximum, for example. Such a multitude of high energy electrons with broad kinetic energy distribution may be favorably converted by means of the electron emitter into a multitude of low energy electrons with reduced kinetic energy distribution, such as reduced to full width at half maximum of about eight to ten electron volts or less. In alternate embodiments, at least some of the particles produced by the particle emitter are low energy electrons appropriate for ECD.

In various embodiments, the device further comprises a magnetic field generator located proximate the volume so that magnetic field lines may reach into the volume and assist in spatially confining the emitted plurality of low energy electrons therein. The magnetic field lines may extend substantially in a direction of emission of the plurality of low energy electrons. The magnetic field lines can be parallel. In alternate embodiments, the magnetic field lines may be configured to create a magnetic mirror. For this purpose, the magnetic field lines can converge between the electron emitter and particle emitter such that a region of low magnetic field line density is proximate the electron emitter and a region of high magnetic field line density is proximate the particle emitter. Such a configuration may result in a force on the electrons in a direction of the lower magnetic field line density and thus contrary to a direction of emission of the plurality of low energy electrons. Generally, a weak magnetic field may increase the dwell time of low energy electrons in the volume. The longer the dwell time is, the more likely it is that an ECD reaction will occur.

In various embodiments the device further comprises an apertured ground electrode located proximate the electron emitter, the volume extending at a side of the apertured ground electrode facing away from the electron emitter and being essentially free of electric fields, wherein at least one aperture in the apertured ground electrode allows to pass the plurality of low energy electrons upon which passing some of the plurality of low energy electrons are deflected laterally. A lateral deflection of low energy electrons entering the volume may serve to decelerate them in a main direction of propagation while at the same time forcing them into a more distinct spiraling motion around the magnetic field lines. In this manner the dwell time of low energy electrons in the volume can be increased thereby promoting ECD reactions. In further advanced embodiments the device may comprise deflection electrodes at the at least one aperture in the apertured ground electrode, the deflection electrodes being operable to warp the electric field in and around the at least one aperture to control the lateral deflection. In certain cases, voltage pulses can be supplied to the deflection electrodes in order to influence the deflection characteristic.

In various embodiments, the device further comprises a device for shaping the plurality of multiply charged cations into a beam and sending the beam in transit through the volume such that a direction of propagation of the emitted plurality of low energy electrons intersects a direction of propagation of the beam. A beam of cations may comprise a plurality of cations flying continuously on a largely predefined trajectory (continuous mode of cation passing), or may comprise separate bunches or packets of cations flying on largely predefined trajectories just during certain time intervals (pulsed mode of cation passing).

In various embodiments, the volume is located between the particle emitter and the electron emitter. Preferably, the device further comprises a focusing device, such as an Einzel lens, located upstream of the volume, assisting in adapting a dimension of the beam to a dimension of the volume. The singular "a focusing device" is not to be construed in a restrictive manner. It is equally possible to provide more than one focusing device upstream of the volume to achieve the desired beam shaping.

In further embodiments, at least one of the particle emitter and the electron emitter has an aperture with an aperture axis, the aperture being passable by the plurality of multiply charged cations, and wherein a direction of emission of the plurality of high energy charged particles and a direction of emission of the plurality of low energy electrons, respectively, is substantially parallel to the aperture axis.

In various embodiments, a kinetic energy of the plurality of low energy electrons is generally less than twenty or ten electron volts, preferably less than one electron volt. The reaction cross section for ECD approaches favorably high levels in this kinetic energy regime.

In some embodiments, the volume is essentially devoid of electric fields (field-free volume). This refers to constant electric fields applied through separate components in the device, and not to highly fluctuating electric fields caused by charge carriers. In case of a microchannel plate as particle emitter and conversion dynode as electron emitter, for instance, the opposing faces of the emitter structures can be kept on ground potential to achieve a field-free volume therebetween. With such design a direction of motion of cations passing the volume will not be altered.

In further embodiments, the device comprises one of an ion mobility separation cell (of any type known in the art) and trapped ion mobility separation cell (such as, for instance, presented by Park in U.S. Pat. No. 7,838,826 B1, the content of which is incorporated herein by reference in its entirety) upstream of the volume, from which the plurality of multiply charged cations is guided to the volume. These separation techniques may entail or cause rapidly time-varying currents of cations being separated according to ion mobility and are therefore advantageously combined with an interaction device or cell as hereinbefore defined wherein ECD on a plurality of multiply charged cations may occur on their continuous passing through the interaction volume. In this manner, intermediate ion storages which hold and subsequently release in a controlled fashion defined packages of cations can be dispensed with and real-time analysis can be executed.

In additional embodiments, the device may further comprise a time-of-flight mass analyzer downstream of the volume, which receives the plurality of multiply charged cations and possible interaction products created in or after the volume. Time-of-flight analyzers (be they of the linear or orthogonal type) are particularly suitable for analyzing rapidly varying ion currents so that an investigation can be carried out at high speed.

In a second aspect, the invention pertains to a method of performing electron capture dissociation on multiply charged cations, comprising providing a plethora of high energy charged particles, directing the plethora of high energy charged particles on to an electron emitter which, upon impingement, emits a plurality of low energy electrons, suitable for efficient electron capture reactions to occur, into a space proximate the electron emitter, and introducing a plurality of multiply charged cations into the space and intermingling them with the emitted plurality of low energy electrons as to allow electron capture dissociation to occur.

In various embodiments, the plethora of high energy charged particles is a result of an electrical amplification process, such as a secondary electron multiplication, and may amount to a current area density equivalent of around one amp per square centimeter; the density can generally range from about 0.1 to 10 amps per square centimeter. The electrical amplification favorably includes converting one trigger event into a multitude of response events at the particle emitter. Preferably, with a microchannel plate a conversion or multiplication factor is between $10^3$ to $10^5$ per channel (conversion characteristic). At the low energy electron emitter one hit of a high energy charged particle may generally lead to a unity response, that is, one low energy electron may be emitted upon one high energy charged particle hitting the electron emitter. In this manner, the plethora of high energy charged particles may cause a substantially equally large number of low energy electrons to be emitted. However, even at fractional responses, such as one low energy electron emitted per two, five or ten, or another number of high energy charged particles larger than one, a low energy electron density in the volume favorable for ECD reactions to occur may be created.

BRIEF DESCRIPTION OF THE DRAWINGS

The invention can be better understood by referring to the following figures. The components in the figures are not necessarily to scale, emphasis instead being placed upon illustrating the principles of the invention (often schematically). In the figures, like reference numerals designate corresponding parts throughout the different views.

DETAILED DESCRIPTION

Figure 1A:
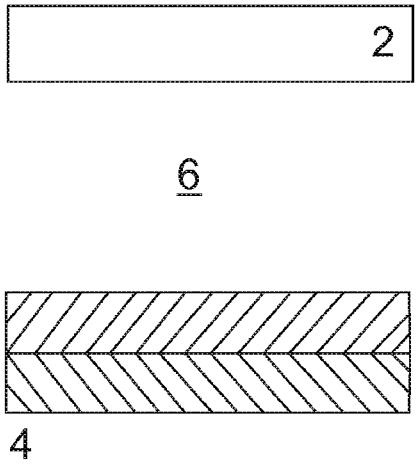
FIGS. 1*a*-1*d* illustrate an embodiment of operation and function of a device for performing electron capture dissociation on multiply charged cations.

FIG. 1*a* shows an exemplary embodiment where a conversion dynode 2 as low energy electron emitter is located opposite a microchannel plate 4 as high energy particle emitter. Between the two emitter structures extends a volume 6 capable of containing a plurality of multiply charged cations, a plurality of high energy charged particles and a plurality of low energy electrons. Upon intermingling of a plurality of low energy electrons with a plurality of multiply charged cations in the volume 6, a multiply charged cation may catch one of the plurality of low energy electrons. This may lead to a recombination in one of the outer molecular orbitals wherein binding energy is released sufficient to initiate bond breakage in the multiply charged electron acceptor cation. The charge state of the multiply charged cations before electron capture dissociation may be any natural number equal to or larger than two (+2, +3, +4, . . . ).

Figure 1B:
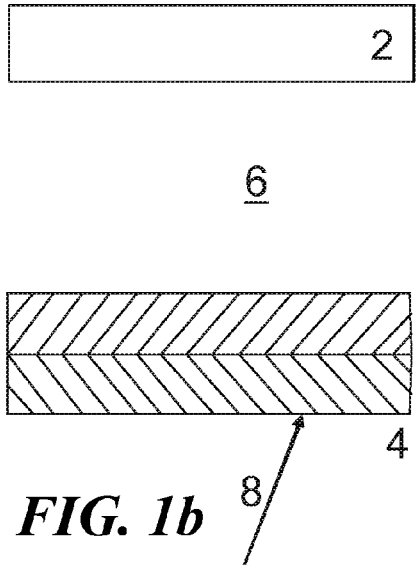

In one example, shown from FIG. 1*b* on, the high energy particle emitter 4 is triggered by exposing it to an incoming trigger entity 8 represented by the one-headed arrow. The trigger entity 8 may be a photon or a plurality of photons (of suitable wavelength such as in the ultraviolet or x-ray regime), a neutral particle or a plurality of neutral particles such as atom(s) or molecule(s), or a charged particle or a plurality of charged particles such as electron(s), ion(s) or the like, likewise of sufficient kinetic energy. The microchannel plate 4 preferably is supplied with high voltage (connections not shown) in order to create the strong electric fields required for effective charge multiplication and abundant high energy charged particle release. The gain per channel and impinging particle may be of the order of $10^3$ to $10^5$, in particular $10^4$, released electrons in this example, but can also be adapted to the needs of the experimenter beyond that range. In certain embodiments, the high energy particle emitter may be triggered by a voltage pulse imparted on the microchannel plate 4 by the supply electronics (not illustrated). In alternate embodiments a channeltron or discrete dynode electron multiplier might be used instead of a microchannel plate.

Figure 1C:
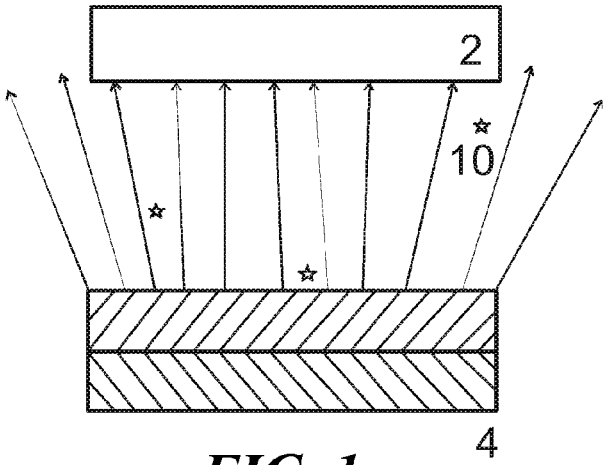

Upon impingement, the trigger entity 8 in this example causes a cascade of high energy charged particles 10, represented as stars in FIG. 1*c*, emanating from a surface of the microchannel plate 4, which comprises openings of the amplification channels (reaching through the plate; not illustrated), and propagating generally in a direction perpendicular to the emission surface towards the low energy electron emitter 2 which faces the surface whence the high energy charged particles 10 are emitted. The plurality of single-headed arrows in FIG. 1*c* shall illustrate by way of example a plurality of trajectories the emitted high energy charged particles 10 may take and indicates the general direction. The kinetic energy of the high energy charged particles 10, electrons in this case, due to the supply voltage at the microchannel plate 4, is generally higher than fifty electron volts, and the energy distribution width thereof is generally much broader than ten electron volts, making them unsuitable for effective electron capture reactions to occur.

As shown in FIG. 1*c*, some of the emitted high energy charged particles 10 impinge on a surface of the conversion dynode 2 opposite the microchannel plate 4. The conversion dynode 2 preferably is supplied with a low voltage (connections not shown) as to avoid too much kinetic energy being imparted to the emitted low energy electrons during release. The voltage may range from about 0.1 to 10 volts for this purpose, for example one volt, being significantly lower than for a conventional dynode application.

Figure 1D:
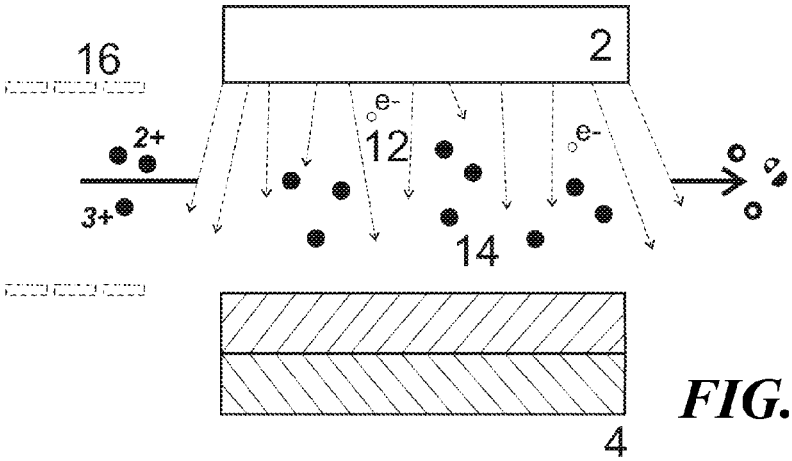

As a result of the high energy charged particles 10 hitting the dynode 2, low energy electrons 12 are released, represented by the hollow balls in FIG. 1*d*, which preferably have a kinetic energy lower than twenty electron volts, and in certain further preferred embodiments less than ten or one electron volt so that the cross section for electron capture reactions of the low energy electrons 12 and a plurality of multiply charged cations 14 (filled balls) present in the same volume is beneficially high. Another beneficial outcome of the high energy electrons hitting the dynode 2 may be that a width of the kinetic energy distribution of the high energy electrons is not translated to the emitted plurality of low energy electrons 12, but that the width is reduced such that a higher proportion of the plurality of low energy electrons 12 has kinetic energies in the favorable low kinetic energy regime. The plurality of multiply charged cations 14 may originate from an ion mobility separation cell or trapped ion mobility separation cell (not shown) located upstream of the volume 6. The plurality of dotted arrows shall illustrate by way of example a plurality of trajectories the emitted low energy electrons 12 may take and indicates the general direction of emission. Due to the large mass of the multiply charged cations compared to a light electron, the contribution of kinetic energy a multiply charged cation makes in an interaction with an electron can be neglected. For example, an ion of 1,000 Dalton mass and having a kinetic energy of ten keV would travel at a velocity just about ten percent of that of an electron having a kinetic energy of a few electron volts.

In FIG. 1*d*, the plurality of multiply charged cations 14 is formed into a beam in a manner known in the art and sent through the volume 6 between the particle emitter 4 and the electron emitter 2. Before entering the volume 6 the beam may be focused as to reduce the risk of some multiply charged cations 14 going astray laterally and hitting one of the electron emitter 2 and the particle emitter 4, which could lead to beam attenuation and interference with the cascade of high energy charged particle and/or low energy electron emission. Such focusing, in the example of FIG. 1*d*, is accomplished by an Einzel lens 16, indicated with broken contours, located upstream of the volume. However, other focusing means known in the art may be equally employed.

Preferably, the ion momentum is large compared to the momentum of low energy electrons 12 such that interaction of the low energy electrons 12 with the multiply charged cations 14 has no significant effect on the flight path of the latter. Even if an interaction of cation 14 and electron 12 leads to the desired ECD, the resultant fragments keep on flying in essentially the same beam direction as the precursor multiply charged cation so that they can be transferred on to subsequent components of a mass spectrometer, such as a mass analyzer, mass filter, ion guide or ion trap and the like (not illustrated). Particularly preferred is a time-of-flight analyzer due to its ability of rapidly acquiring mass spectra which can temporally resolve the time-varying ion currents. Subsequently, a mass spectrum of the dissociated fragment ions may be acquired and evaluated towards a (amino acid) sequence analysis, for example.

The operation and function of the device have been described above with reference to an exemplary embodiment in a step-by-step manner, from triggering of the microchannel plate, emission of high energy charged particles, triggering of the conversion dynode, emission of low energy electrons, to intermingling of low energy electrons with multiply charged cations. However, it goes without saying that this operation can proceed continuously where some or all of the aforementioned steps happen at the same time. For example, the high energy particle emitter may be triggered with a frequency which corresponds to the longer of an inherent recovery time (or recharging time) of the high energy particles emitter and an inherent recovery time of the low energy electron emitter. Such recovery times may be in a few hundred milliseconds regime. Since the low energy electrons emitted need some time for reaching the opposing spatial constraint of the volume, and due to the high number of low energy electrons emitted in one "burst", a quasi-permanent electron "curtain" of high density may be created within the volume. With the low energy electrons being almost omnipresent in large numbers within the volume, a beam of multiply charged cations, having an ion current amplitude which can vary rapidly with time, may pass the volume at any time for the desired ECD to occur.

Figure 2A:
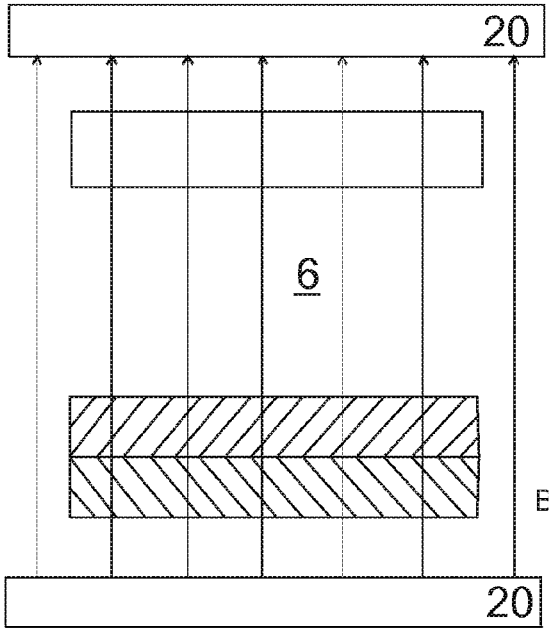
FIGS. 2*a*-2*b* illustrate embodiments of a device for performing electron capture dissociation equipped with a magnetic field generator.
Figure 2B:
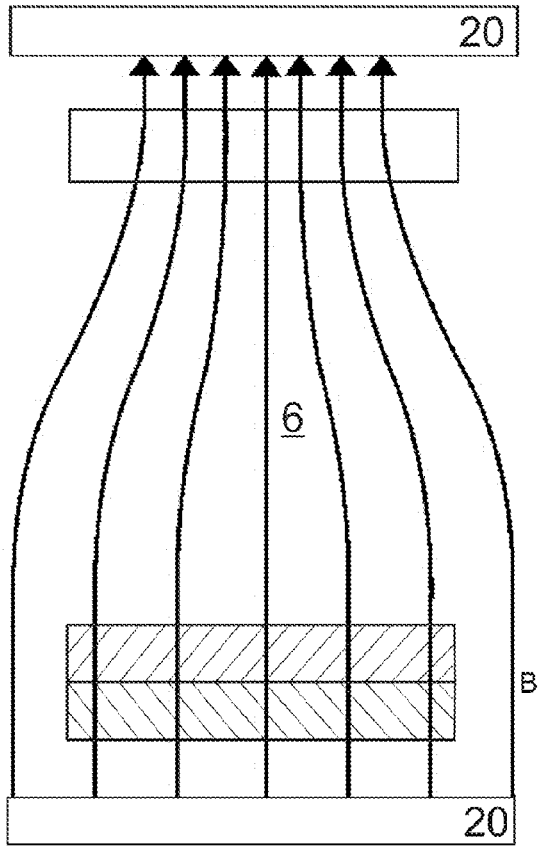

As illustrated in FIG. 1*d* not all of the plurality of low energy electrons 12 are emitted perpendicularly to a surface of the dynode 2, but may move sideways to some degree. An optional weak magnetic field as illustrated in FIGS. 2*a-b* may assist in confining the emitted plurality of low energy electrons to the volume 6 between the microchannel plate and the conversion dynode. A magnetic field generator 20 is disposed around the microchannel plate and conversion dynode such that magnetic field lines B extend across the volume 6 essentially in the same direction of emission of the low energy electrons. According to the three-finger rule, charged particles, such as electrons, that move non-parallel to magnetic field lines B experience a force which deviates them orthogonally to the direction of the magnetic field lines B and the initial motion component perpendicular thereto. As a result, the charged particles will end up in a circular orbit, and, if a motion component along the magnetic field line exists, in a spiraling orbit around the magnetic field lines B. The latter will be the case largely in the embodiment depicted in FIG. 2*a*, thereby ensuring that low energy electrons do not leave the volume laterally and are longer available for interaction with the incoming plurality of multiply charged cations. The magnitude of the magnetic field is advantageously chosen such that only the light low energy electrons experience a magnetic constraint, whereas the much heavier multiply charged cations are not perceptibly affected by it. Possible magnitudes range from 1 mT to about 500 mT, in particular 50 mT.

FIG. 2*b* shows an alternative embodiment comprising a magnetic field generator where the magnetic field lines converge between a region of low magnetic field line density proximate the low energy electron emitter and a region of higher magnetic field line density proximate the particles emitter. In this arrangement, a magnetic mirror can be created that exerts a force on the charged particles moving in the magnetic field, which is directed towards a region of lower magnetic field line density, that is, in a direction of the electron emitter in this case. Such embodiment may assist in the confinement of the plurality of emitted low energy electrons and is given by way of example only. Other magnetic mirror configurations deviating from the one depicted in FIG. 2*b* may likewise be employed.

In FIGS. 2*a*-2*b* the magnetic field lines B extend generally perpendicularly to the emission surfaces of high energy charged particles and low energy electrons. This is not mandatory. A magnetic confinement effect can at least temporarily be achieved, for example, also when the magnetic field lines B extend in a direction generally perpendicular to the plane of projection. The exact arrangement, as the case may be with an angled alignment of the magnetic field lines, can be chosen by a skilled worker in accordance with the general requirements to prolong the dwell times of low energy electrons within the volume. Furthermore, it is possible to not have a continuous magnetic field which crosses the volume through all of the method steps depicted in FIGS. 1*a*-1*d*, but to switch on the magnetic field only in those instances in which low energy electrons are actually present in the volume, such as seen in FIG. 1*d*, so that during the other steps the volume is essentially free of magnetic field lines.

Figure 2C:
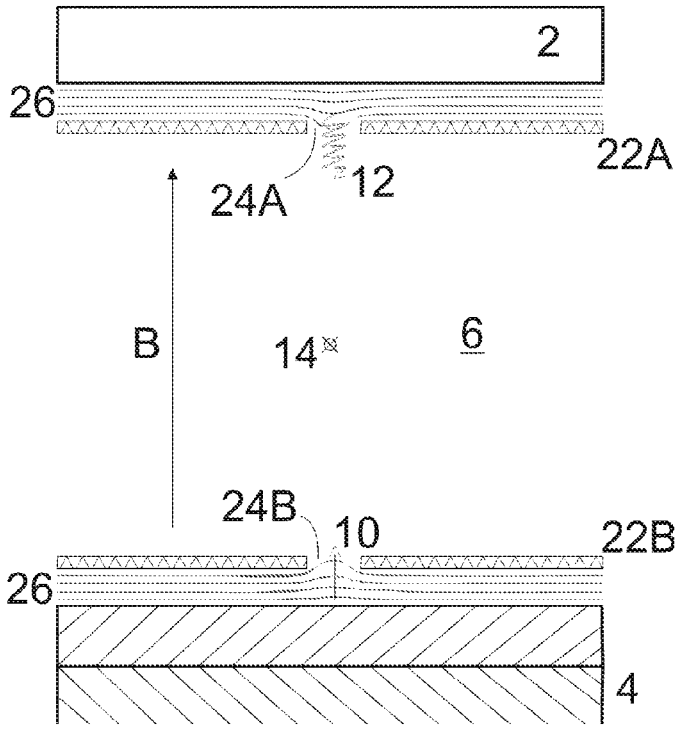
FIGS. 2*c*-2*d* illustrate embodiments of the device with magnetic field assisted confinement of low energy electrons, which employ additional electrodes.

FIG. 2*c* illustrates another advantageous embodiment of the device with magnetic field assisted confinement of the low energy electrons. The view on the device in FIG. 2*c* has been turned by 90 degrees around an axis in the plane of projection such that the observer now looks in the direction of propagation of the plurality of multiply charged cations 14, which consequently extends perpendicularly into the plane of projection (as indicated by the crossed circle in the center of the drawing). A magnetic field generator (not shown) creates magnetic field lines B in a configuration similar to the one depicted in FIG. 2*a*, that is substantially parallel to one another and generally perpendicular to the opposing faces of multichannel plate 4 and conversion dynode 2. For the sake of clarity, just one magnetic field line B is indicated in FIG. 2*c*.

In addition to the components shown in FIGS. 2*a*-2*b*, the embodiment of FIG. 2*c* comprises a first apertured ground electrode 22A located proximate the electron emitter 2. By way of example, the first apertured ground electrode 22A is a slitted plate electrode. However, other configurations, such as with more than one slit or aperture, are also conceivable. Furthermore, a second apertured ground electrode 22B (likewise a slitted plate electrode) is foreseen which is located proximate the particle emitter 4. The apertures or slits 24A, 24B are arranged such that they define a common straight axis in this case. The conversion dynode 2 and emission surface of the microchannel plate 4 are preferably held at a low voltage, such as one volt. The volume 6 generally extends at a side of the first apertured ground electrode 22A facing away from the electron emitter 2, in this case between the first apertured ground electrode 22A and the second apertured ground electrode 22B. Due to the two apertured electrodes 22A, 22B being grounded the volume 6 is essentially free of electric fields so that the propagation of a plurality of multiply charged cations 14 is hardly influenced on its way through the volume 6 (slight deviations from ground potential may be acceptable as long as the effect on the passing multiply charged cations is small). The aperture or slit 24B in the second apertured ground electrode 22B allows the plurality of high energy charged particles 10 to pass as indicated by the straight hollow arrow. The aperture or slit 24A in the first apertured ground electrode 22A allows at least a portion of the plurality of high energy charged particles 10 to pass so that it may impinge on a portion of the electron emitter 2 thereby initiating the release of a plurality of low energy electrons 12. The plurality of low energy electrons 12 then may pass the aperture or slit 24A in the first apertured ground electrode 22A in the opposite direction as indicated by the spiraling hollow arrow.

Equipotential lines 26, resulting from a SIMION® calculation assuming static potential settings, between the two apertured ground electrodes 22A, 22B and the conversion dynode 2 and the microchannel plate 4, respectively, show how the electric field is distorted at the apertures 24A, 24B. The distorted field will tend to deflect electrons laterally to the magnetic field B as they pass through the aperture 24A, 24B. The deflection will be more pronounced for lower energy electrons. Thus, high energy electrons 10 produced by the microchannel 4 plate are largely unaffected by passage through the apertures 24A, 24B on their way to the dynode 2, however, low energy electrons 12 produced at the dynode 2 (and microchannel plate 4) will be deflected at the apertures 24A, 24B. This converts some of the kinetic energy of the electrons into cyclotron motion. Electrons starting with a total (that is combined potential and kinetic) energy of one eV at the dynode 2, for example, will have some of this energy converted into cyclotron motion. As a result the electrons will not have enough kinetic energy in a direction of extension of the magnetic field B to return to the dynode 2. Instead the electrons are reflected repeatedly back and forth in the volume 6. Such a "side kick" effect has been described by Caravatti in U.S. Pat. No. 4,924,089, the content of which is incorporated herein by reference in its entirety, in conjunction with an ion cyclotron resonance cell.

Figure 2D:
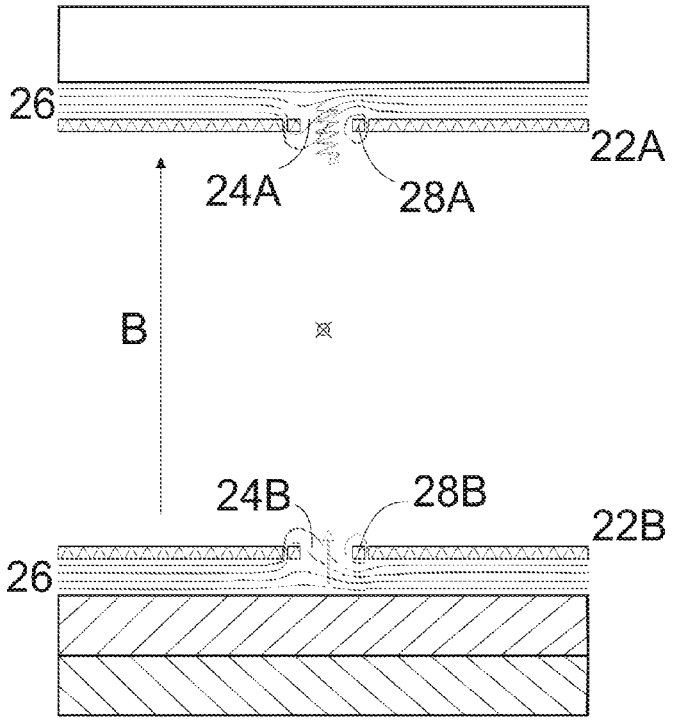

FIG. 2*d* shows yet a further modification of the embodiment of FIG. 2*c* in that it additionally comprises pairs of deflection electrodes 28A, 28B at the apertures or slits 24A, 24B in the first and second apertured ground electrodes 22A, 22B. The deflection electrodes 28A, 28B are operable to warp the electric field in and around the apertures 24A, 24B to control the lateral deflection. Either a continuous or pulsed voltage may be applied to the deflection electrodes 28A, 28B. The addition of deflection electrodes 28A, 28B adds a degree of control of the lateral deflection of the low energy electrons. In this way, the deflection of the electrons can be adjusted electrically. Operation voltages of the deflection electrodes 28A, 28B may be of the order of 0.5 volts. By way of example, the distortion of the electric field becomes apparent from the equipotential lines 26 between the apertured ground electrodes 22A, 22B and the dynode 2 and the microchannel plate 4, respectively, shown in FIG. 2*d*.

The embodiments of FIGS. 2*c*-*d* feature slitted electrode plates as apertured ground electrodes. However, it would be equally possible to achieve the same effect with other configurations, such as an electrode composed of an assembly of parallel wires. Also, two assemblies of parallel wires arranged to intersect each other at a certain angle would create a grid electrode that is suitable for the purpose. Such a grid electrode would have more than one aperture, or a multitude of apertures, yielding an enlarged area through which electrons can pass. Other modifications of the apertured ground electrode may comprise two separate electrode halves spaced apart by a gap which would serve as aperture. In that case, the two halves could be located at different distances to the electron emitter so that a spatial distortion of the electric field in the gap or aperture regions results. In this manner, a more pronounced lateral deflection of electrons could be achieved.

It should be mentioned that the second apertured ground electrode in the afore-described embodiments serves mainly to create a volume free of electric fields. This could also be achieved by holding the emission surface of the particle emitter on ground potential. As a result, the second apertured ground electrode could be omitted. However, employing the second apertured ground electrode allows more flexible tuning of the operating voltages of the particle emitter. Moreover, in the afore-described embodiments the first and second apertured ground electrodes have the same configuration. But it goes without saying that, if a second apertured ground electrode is to be employed, its design may differ from the one used for the first apertured ground electrode. For instance, the first apertured ground electrode may have deflection electrodes whereas the second does not.

Figure 3:
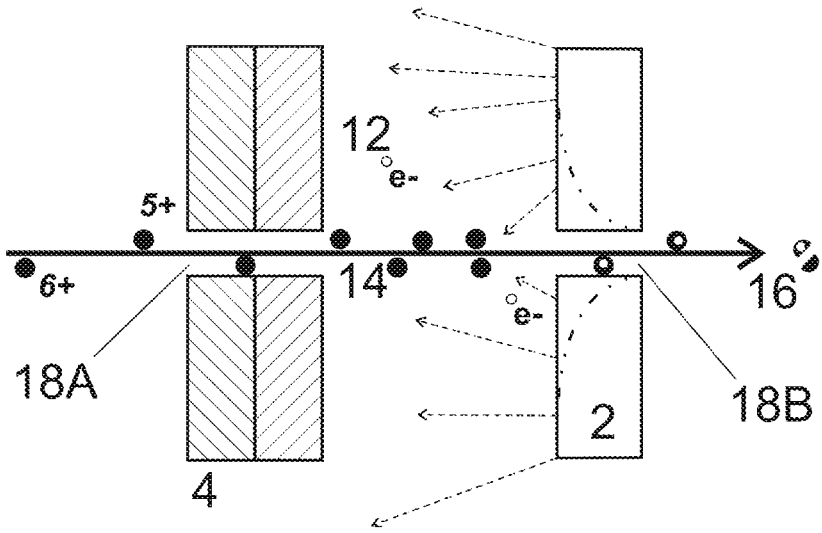
FIG. 3 shows an embodiment differing from the one shown in FIGS. 1*a*-1*d*.

FIG. 3 shows another embodiment wherein an axis of propagation 16 of the plurality of multiply charged cations 14 (now again from left to right in the figure) and a general direction of emission of the plurality of low energy electrons 12 do not intersect, but are essentially parallel (even concentric or coaxial). For that purpose, the particle emitter 4 and the low energy electron emitter 2 each have a central through aperture 18A, 18B. The apertures 18A, 18B are aligned with each other such that a straight passage for the incoming plurality of multiply charged cations 14 is created. In this particular embodiment, the lateral motion component of the emitted low energy electrons 12 is advantageously employed to cause them to cross the trajectory of the beam of multiply charged cations 14 where they may interact to induce ECD. In order to further favor the emission of low energy electrons 12 in a direction of the beam axis 16 of the plurality of multiply charged cations 14, the surface of the electron emitter 2 may be curved, indicated in FIG. 3 by a dash-dotted contour, as to advantageously influence the geometrical emission characteristic. In further embodiments, not illustrated, the through apertures in the particle emitter and the low energy electron emitter may be inclined towards the emission surfaces, such that a common axis of the through apertures is aligned at an angle of less than 90 degrees towards the opposing emission surfaces.

Figure 4:
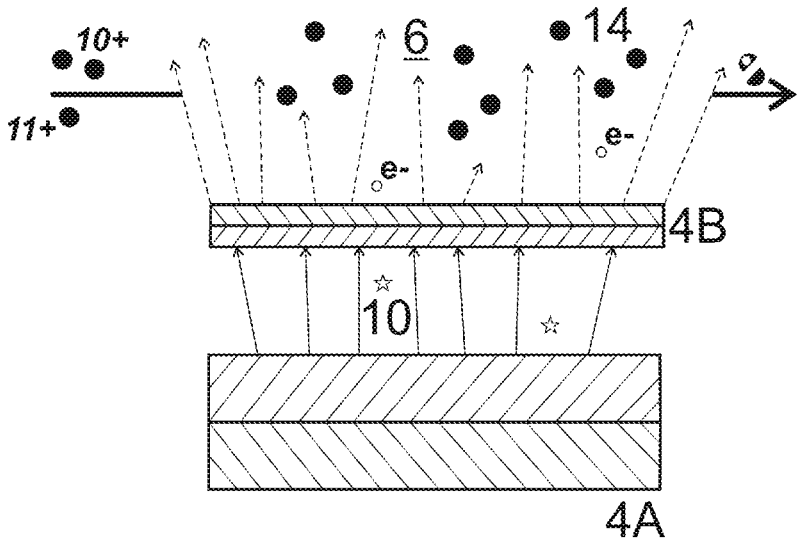
FIG. 4 shows yet another embodiment differing from the one shown in FIGS. 1*a*-1*d*.

FIG. 4 shows another embodiment wherein the emission surface of the electron emitter 4B and the emission surface of the particle emitter 4A do not face each other. Instead, the trigger impulse(s) and the emission happen at different sides. The emitted plurality of high energy charged particles 10 impinges on a back side of the electron emitter 4B and triggers the emission of a plurality of low energy electrons 12 from a surface facing away from the particle emitter 4A. In this case, the volume 6 is located at the side of the electron emitter 4B facing away from the particle emitter 4A. With this design, at least at one side, the volume 6 does not have to be exposed to a spatial restriction making it easier to guide a beam of multiply charged cations 14 through the volume 6. An implementation of the electron emitter 4B in FIG. 4 may feature a microchannel plate that is sufficiently thin. When the microchannel plate 4B in this example is supplied with sufficiently low operation voltages, the energy of the high energy charged particles may be sufficient only to cause emission of electrons with appropriately low kinetic energy, in the order of about twenty electron volts or less, so that they are well suited for ECD on multiply charged cations in the volume.

In the afore-described embodiments, the cations are basically continuously passed once through the volume containing low energy electrons. However, in other embodiments it is possible to arrange for several transits of the cations through the volume. For example, upstream of the volume and downstream of the volume there may be situated ion traps, such as radio frequency ion traps, respectively, which receive, store and as the case may be emit undissociated cations in a direction of the volume. The fragments already created during a transit through the volume, on the other hand, may be passed on downstream to a mass analyzer as indicated above. It may be particularly economic to generate the low energy electrons in a pulsed manner in the volume only in those instances when cations actually pass the volume. The exposure of the particle emitter to a trigger entity and the switching on/off of supply voltages to the particle emitter and, as the case may be, the electron emitter may be timed accordingly.

It will be understood that various aspects or details of the invention may be changed, or that different aspects disclosed in conjunction with different embodiments of the invention may be readily combined if practicable, without departing from the scope of the invention. Furthermore, the foregoing description is for the purpose of illustration only, and not for the purpose of limiting the invention, which is defined solely by the appended claims.

What is claimed is:

1. A device for performing electron capture dissociation on multiply charged cations, comprising:

a particle emitter that, in response to receiving a trigger, emits a plurality of high energy charged particles;

an electron emitter positioned to receive the plurality of high energy particles and, in response thereto, emit a plurality of electrons having energies suitable for electron capture reactions; and a volume located adjacent to the electron emitter that receives the plurality of electrons upon emission and into which a plurality of multiply charged cations is introduced so that electron capture dissociation occurs.

2. The device of claim 1, wherein the electron emitter is a conversion dynode.

3. The device of claim 1, wherein the particle emitter is a microchannel plate, and the high energy charged particles are high energy electrons.

4. The device of claim 1, further comprising a magnetic field generator that generates magnetic field lines in the volume to assist in spatially confining the plurality of electrons therein.

5. The device of claim 4, wherein the magnetic field lines extend substantially in a direction of emission of the plurality of electrons.

6. The device of claim 4, further comprising a ground electrode located between the electron emitter and the volume so that the volume is essentially free of electric fields, the ground electrode having at least one aperture that allows the plurality of electrons to pass through the ground electrode and enter the volume, the aperture producing electric field that causes some of the plurality of electrons to be deflected laterally as they pass through the ground electrode.

7. The device of claim 6, further comprising deflection electrodes at the at least one aperture in the apertured ground electrode, the deflection electrodes being operable to warp the electric field in and around the at least one aperture to control the lateral deflection.

8. The device of claim 1, further comprising a device for shaping the plurality of multiply charged cations into a beam and sending the beam in transit through the volume such that a direction of propagation of the emitted plurality of electrons intersects a direction of propagation of the beam.

9. The device of claim 8, wherein the volume is located between the particle emitter and the electron emitter.

10. The device of claim 9, further comprising a focusing device, located upstream of the volume in the direction of the beam, that assists in adapting a dimension of the beam to a dimension of the volume.

11. The device of claim 1, wherein at least one of the particle emitter and the electron emitter has an aperture with an aperture axis, wherein the plurality of multiply charged cations pass by the aperture and a direction of emission of the plurality of high energy charged particles and a direction of emission of the plurality of electrons, respectively, is substantially parallel to the aperture axis.

12. The device of claim 1, wherein the volume and the particle emitter are located on opposing sides of the electron emitter, and wherein the electron emitter receives the portion of the emitted plurality of high energy charged particles at one side and emits the plurality of electrons from an opposing side.

13. The device of claim 1, wherein the plurality of electrons have a kinetic energy of less than twenty electron volts.

14. The device of claim 13, wherein the kinetic energy is less than ten electron volts.

15. The device of claim 1, further comprising one of an ion mobility separation cell and a trapped ion mobility separation cell from which the plurality of multiply charged cations is guided to the ion volume.

16. The device of claim 1, further comprising a time-of-flight mass analyzer that receives the plurality of multiply charged cations and any interaction products created when the multiply charged cations pass though the volume.

17. A method of performing electron capture dissociation on multiply charged cations, comprising:

(a) providing a plethora of high energy charged particles;

(b) directing the plethora of high energy charged particles onto an electron emitter which, in response to the high energy charged particles, emits a plurality of electrons with energies suitable for efficient electron capture reactions to occur into a space proximate the electron emitter;

(c) introducing a plurality of multiply charged cations into the space; and (d) intermingling the multiply charged cations with the emitted plurality of electrons as to allow electron capture dissociation to occur.

18. The method of claim 17, wherein the plethora of high energy charged particles is produced by an electrical amplification process.

19. The method of claim 18, wherein the electrical amplification process comprises a conversion process that converts a single trigger event into the plurality of electrons.

20. The method of claim 19, wherein the conversion process has a conversion factor of between $10^3$ to $10^5$.

* * * * *